US008281458B2

(12) United States Patent
Balbo di Vinadio

(10) Patent No.: US 8,281,458 B2
(45) Date of Patent: Oct. 9, 2012

(54) HINGE FOR DOORS, WINDOWS, OR THE LIKE

(75) Inventor: Aimone Balbo di Vinadio, Chiusa San Michele (IT)

(73) Assignee: Savio S.p.A., Chiusa San Michele (Torino) (IT)

( * ) Notice: Subject to any disclaimer, the term of this patent is extended or adjusted under 35 U.S.C. 154(b) by 385 days.

(21) Appl. No.: 12/625,306

(22) Filed: Nov. 24, 2009

(65) Prior Publication Data

US 2010/0139039 A1 Jun. 10, 2010

(30) Foreign Application Priority Data

Dec. 5, 2008 (EP) ..... 08425776

(51) Int. Cl.
*E05D 7/04* (2006.01)

(52) U.S. Cl. ..... 16/235; 16/242; 16/250

(58) Field of Classification Search ..... 16/235–238, 16/242, 245, 246, 250, 251, 387
See application file for complete search history.

(56) References Cited

U.S. PATENT DOCUMENTS

| | | | | |
|---|---|---|---|---|
| 1,484,536 | A * | 2/1924 | Alban | 16/242 |
| 2,724,144 | A * | 11/1955 | Lohrman | 16/242 |
| 4,937,916 | A * | 7/1990 | Redman | 16/243 |
| 5,964,012 | A * | 10/1999 | Vigreux | 16/241 |
| 6,397,432 | B1 * | 6/2002 | di Vinadio | 16/242 |
| 6,757,938 | B1 * | 7/2004 | di Vinadio | 16/242 |
| 7,162,774 | B1 * | 1/2007 | Von Resch et al. | 16/236 |
| 7,500,286 | B2 * | 3/2009 | Soviknes | 16/243 |
| 2011/0041288 | A1 * | 2/2011 | Pacini | 16/244 |
| 2011/0099755 | A1 * | 5/2011 | Reichel | 16/251 |

FOREIGN PATENT DOCUMENTS

| | | |
|---|---|---|
| DE | 20 2004 013 848 | 2/2006 |
| EP | 1 061 221 | 5/2000 |
| EP | 1173649 | 8/2004 |
| EP | 1 598 510 | 5/2007 |

OTHER PUBLICATIONS

EP Search Report for Application No. EP 08 42 5776 dated Apr. 8, 2009.

* cited by examiner

*Primary Examiner* — William L. Miller
(74) *Attorney, Agent, or Firm* — Patterson & Sheridan, LLP

(57) ABSTRACT

A hinge for doors, windows, or the like, comprising, a first hinge element and a second hinge element, which have, respectively, a first cylindrical articulation portion and a second cylindrical articulation portion, wherein the first articulation portion has an external diameter smaller than the external diameter of the second articulation portion; a hingepin, which defines a hinge axis; an adjustment device, which is associated to one of said articulation portions and can be actuated for displacing said hinge elements with respect to one another in a direction substantially transverse to said hinge axis; and a covering sleeve, provided externally to the first articulation portion and having an external diameter equal to the external diameter of said second articulation portion, wherein the covering sleeve is mounted so that it can turn with respect to the first articulation portion about an axis that is eccentric with respect to said hinge axis and can be displaced with respect to the first articulation portion in a direction substantially transverse to the hinge axis, the covering sleeve and the first hinge element being provided with toothings kept elastically in a condition of mutual engagement.

5 Claims, 6 Drawing Sheets

HINGE FOR DOORS, WINDOWS, OR THE LIKE

CROSS-REFERENCE TO RELATED APPLICATIONS

This application claims benefit of European patent application number 08425776.5, filed Dec. 5, 2008, which is herein incorporated by reference.

BACKGROUND OF THE INVENTION

1. Field of the Invention

The present invention relates to a hinge for doors, windows, or the like, comprising a first hinge element and a second hinge element articulated together by means of a hingepin and including an adjustment mechanism associated to one of said hinge elements, which can be actuated for displacing said hinge elements with respect to one another in a direction substantially transverse to the hinge axis.

2. Description of the Related Art

EP1173649B1 discloses a hinge wherein two hinge elements have respective cylindrical articulation portions of different diameter. A covering sleeve is set on the outside of the articulation portion of smaller diameter. Said covering sleeve has the purpose of masking the misalignment between the cylindrical articulation portions of the first and second hinge elements that occurs following upon adjustment of the relative position of the two hinge elements in a direction transverse to the hinge axis. In the solution described in the document No. EP1173649, the covering sleeve is anchored to one end of the cylindrical portion of larger diameter.

The solution described in EP1173649 envisages that the adjustment device is housed in the articulation portion that is surrounded by the covering sleeve (the cylindrical portion of smaller diameter). The solution described in this document is scarcely applicable to hinges in which the device for adjustment in a transverse direction is housed in the articulation portion of larger diameter. The solution described in EP1173649 is also scarcely applicable in the cases where the device for adjustment in a transverse direction is controlled through the top end of one of the two hinge elements.

SUMMARY OF THE INVENTION

The object of the present invention is to provide a hinge for doors and windows of the type referred to above that will enable the drawbacks of the known art to be overcome.

According to the present invention, said object is achieved by a hinge comprising:

a first hinge element and a second hinge element, which have, respectively, a first cylindrical articulation portion and a second cylindrical articulation portion with respective seats, wherein the first articulation portion has an external diameter smaller than the external diameter of the second articulation portion;

a hinge pin, which extends within said seats and defines a hinge axis;

an adjustment device, which is associated to one of said articulation portions and can be actuated for displacing with respect to one another said hinge elements in a direction substantially transverse to said hinge axis; and a covering sleeve, which is provided externally to the first articulation portion and has an external diameter equal to the external diameter of said second articulation portion, wherein the covering sleeve is mounted so that it can turn with respect to the first articulation portion about an axis that is eccentric with respect to said hinge axis and can be displaced with respect to the first articulation portion in a direction substantially transverse to the hinge axis, the covering sleeve and the first hinge element being provided with toothings kept elastically in a condition of mutual engagement.

BRIEF DESCRIPTION OF THE DRAWINGS

Characteristics and advantages of the present invention will emerge clearly in the course of the ensuing detailed description, which is provided purely by way of non-limiting example, with reference to the attached drawings, wherein.

DETAILED DESCRIPTION

Figure 1:
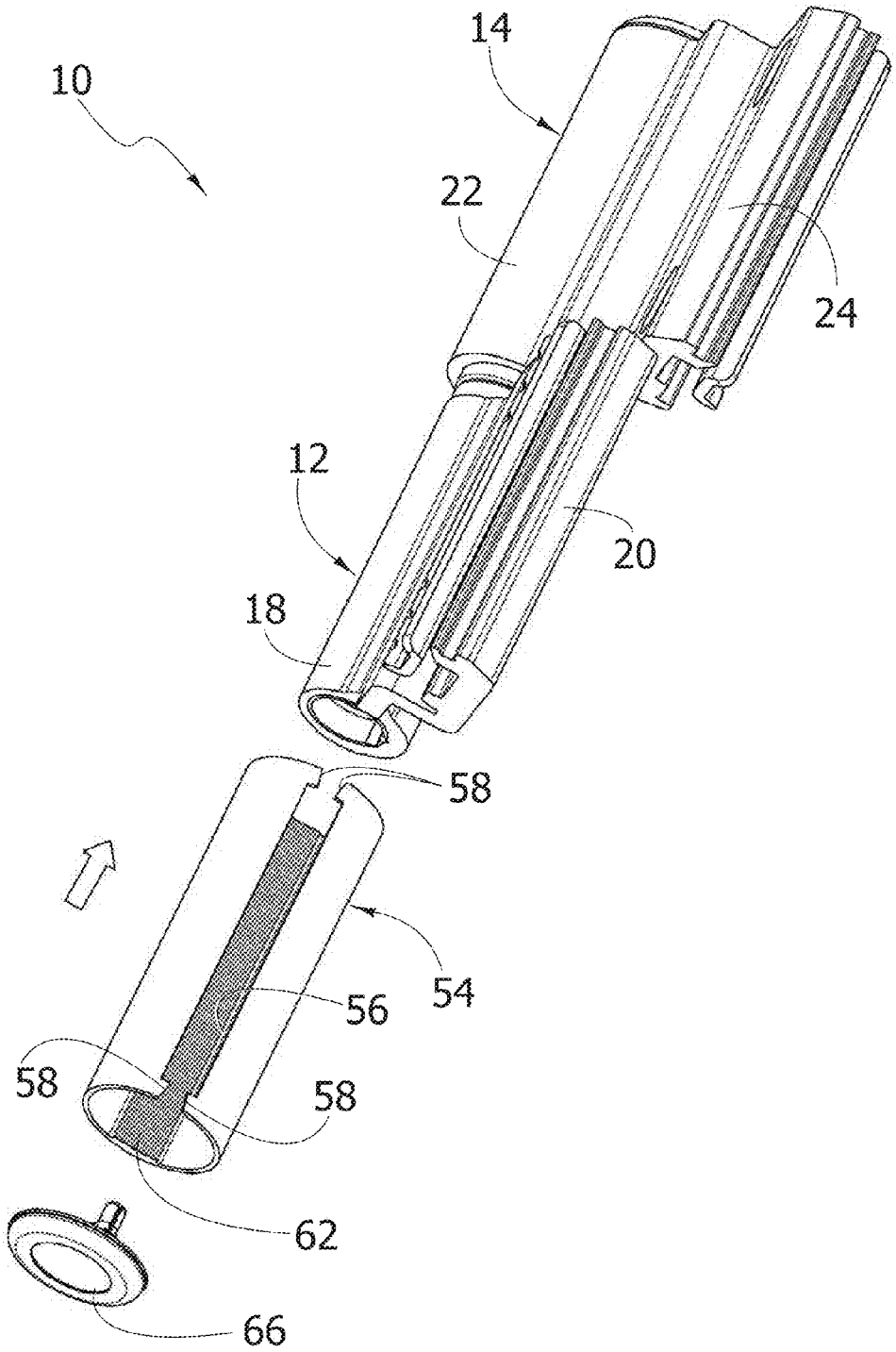
FIG. 1 is a partially exploded perspective view of a hinge according to the present invention.
Figure 2:
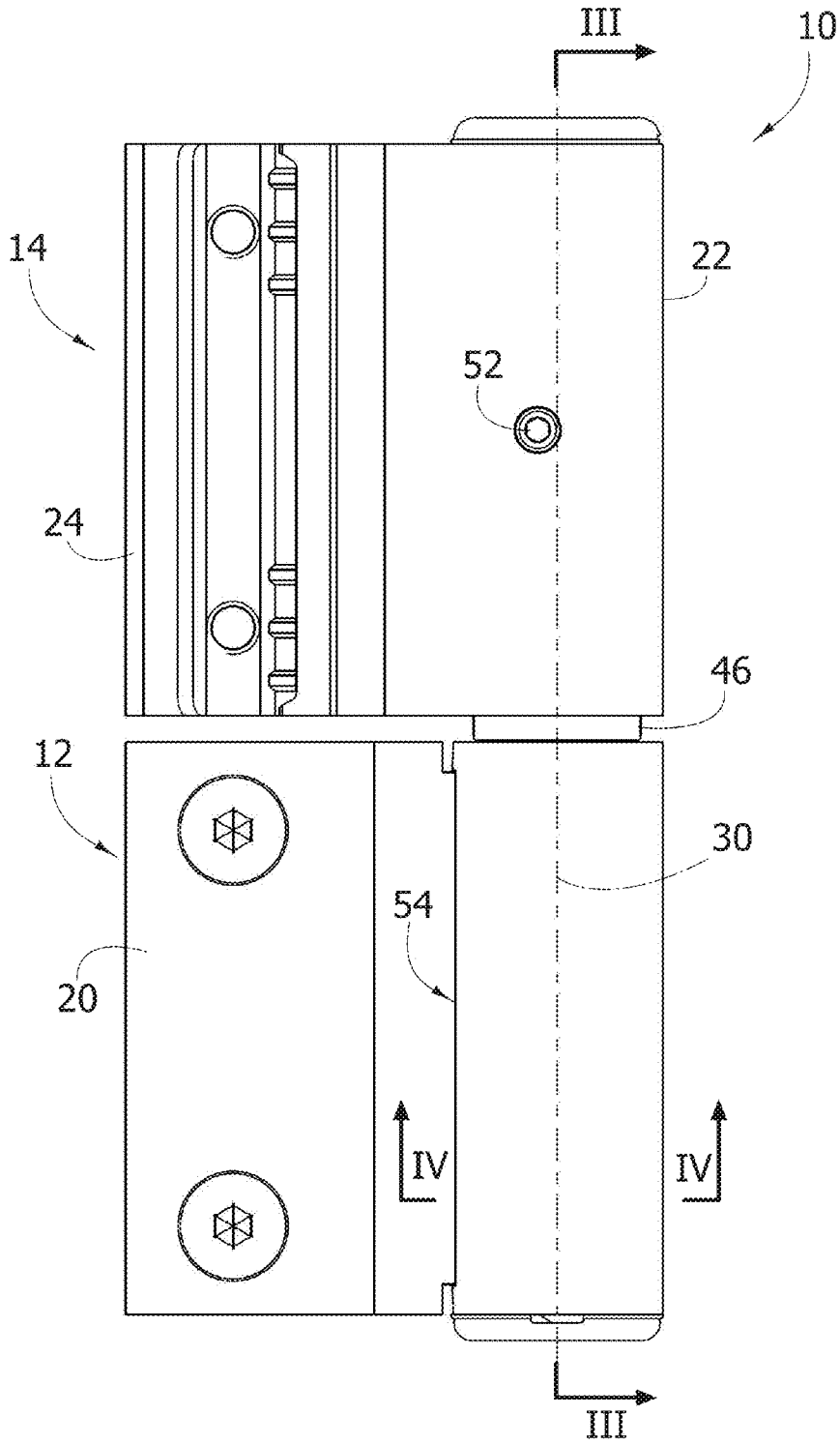
FIG. 2 is a side view of the hinge of FIG. 1.
Figure 3:
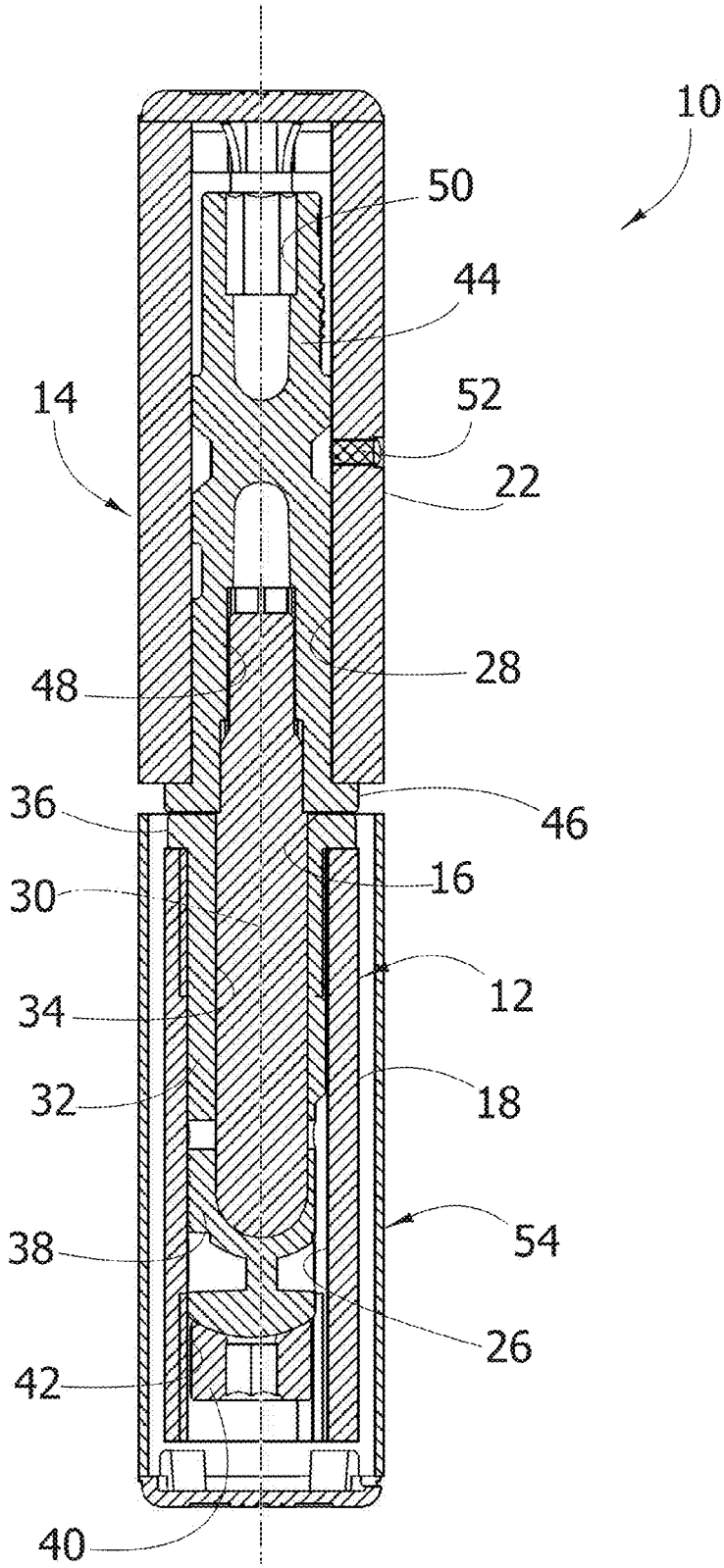
FIG. 3 is a cross section according to the line III-III of FIG. 2.

With reference to FIGS. 1 to 3, designated by 10 is a hinge for doors or windows. The hinge 10 comprises a first hinge element 12 and a second hinge element 14. The hinge elements 12, 14 are articulated together by means of a hingepin 16 (FIG. 3) that defines a hinge axis 30. The first hinge element 12 has a first cylindrical articulation portion 18 and a leaf 20 designed to be fixed to a fixed frame (not illustrated). The second hinge element 14 has a second cylindrical articulation portion 22 and a leaf 24 designed to be fixed to the mobile leaf of a door or window (not illustrated). The articulation portions 18, 22 are provided with respective cylindrical seats 26, 28 (FIG. 3), extending in which are a bottom portion and a top portion of the pin 16. In use, the hinge axis 30 extends in a vertical direction, and the articulation portions 18, 22 are set vertically on top of one another, with the first articulation portion 18 set underneath the second articulation portion 22. The first articulation portion 18 has an external diameter smaller than the external diameter of the second articulation portion 22.

With reference to FIG. 3, housed in the seat 26 of the articulation portion 18 of the first hinge element 12 is a bushing 32 having an articulation seat 34 engaged, in such a way that it can turn, by a bottom end portion of the pin 16. The bushing 32 has, at its top end, a radial collar 36 that rests on the top edge of the articulation portion 18. The bushing 32 is fixed with respect to the articulation portion 18. The bushing 32 has a part 38 with a hemispherical seat, resting against which is the bottom end of the pin 16, which is also hemispherical. The bushing 32 rests on a threaded member 40, which engages a threaded stretch 42 of the seat 26. The threaded member 40 can be turned by means of a spanner (not illustrated) to vary the position of the pin 16 in the direction of the hinge axis 30.

The hinge 10 comprises an adjustment device associated to the second hinge element 14 and can be actuated for adjusting the relative position between the hinge elements 12, 14 in a direction substantially transverse to the hinge axis 30. Said adjustment device is of the type described in EP1061221A1 and comprises a cam 44 that engages, in such a way that it can turn about the axis 30, the seat 28 of the articulation portion 22 of the second hinge element 14. The cam 44 has, at its bottom end, a radial collar 46, on which the bottom front edge of the articulation portion 22 rests.

Formed in the bottom part of the cam 44 is a seat 48, in which the top end of the pin 16 is fixed. The seat 48 is eccentric with respect to the longitudinal axis of the seat 28. Provided at the top end of the cam 44 is a hexagonal cavity 50 that can be engaged by a spanner, which enables rotation of the cam 44 within the seat 28. Rotation of the cam 44 within the seat 28 enables variation of the distance between the hinge axis 30 and the longitudinal axis of the articulation portion 22. This adjustment hence enables displacement, in a direction substantially transverse to the hinge axis 30, of the second hinge element 14 with respect to the first hinge element 12. The cam 44 is fixed in the desired adjustment position by means of a radial screw 52. Following upon said adjustment, the axes of the two articulation portions 18, 22 may be staggered with respect to one another.

The hinge 10 comprises a covering sleeve 54, which extends on the outside of the first articulation portion 18 (the articulation portion with smaller diameter). The covering sleeve 54 has an external diameter substantially equal to the external diameter of the second articulation portion 22 (the articulation portion of larger diameter).

The sleeve 54 is thin-walled and has a tubular shape and can be made of plastic or metal material with elastic characteristics. Formed on the side wall of the covering sleeve 54 is a through opening 56, which extends between the opposed front ends of the sleeve 54. Formed in a position corresponding to the ends of the opening 56 are two pairs of teeth 58, which have the purpose of constraining the sleeve 54 axially to the first hinge element 12.

Figure 4:
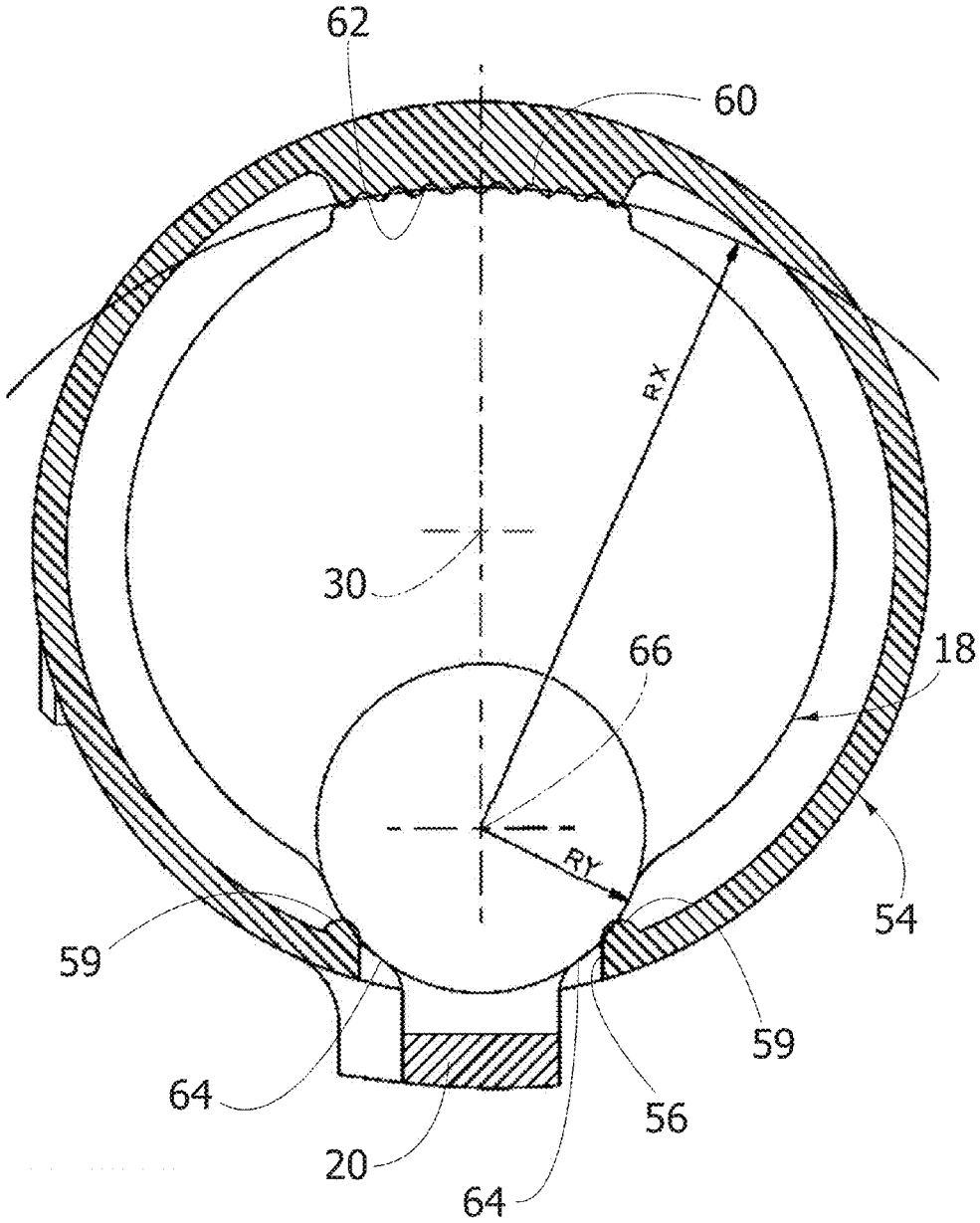
FIG. 4 is a cross section according to the line IV-IV of FIG. 2.
Figure 5:
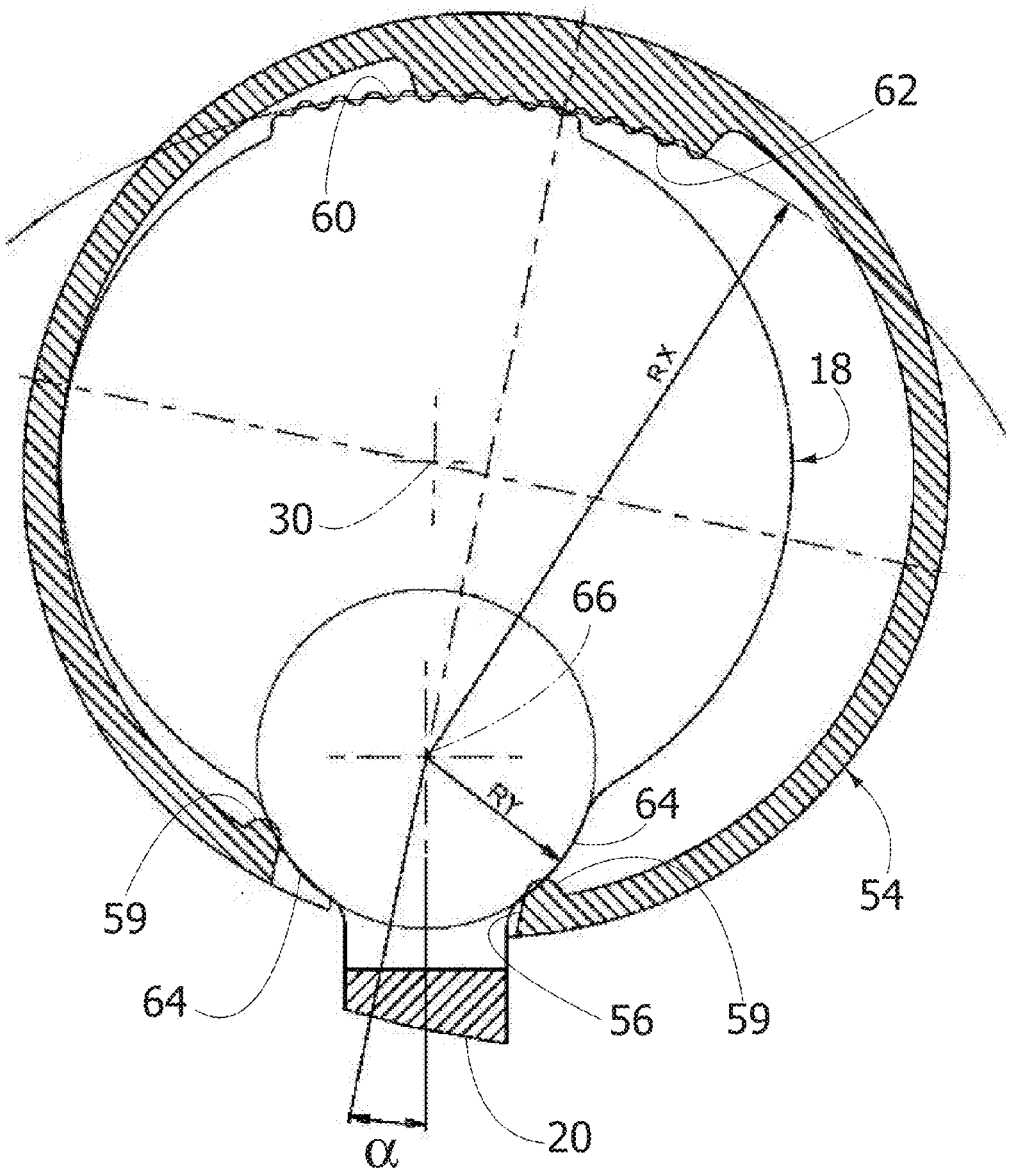
FIGS. 5 and 6 are sections corresponding to FIG. 4 illustrating different positions of the covering sleeve.
Figure 6:
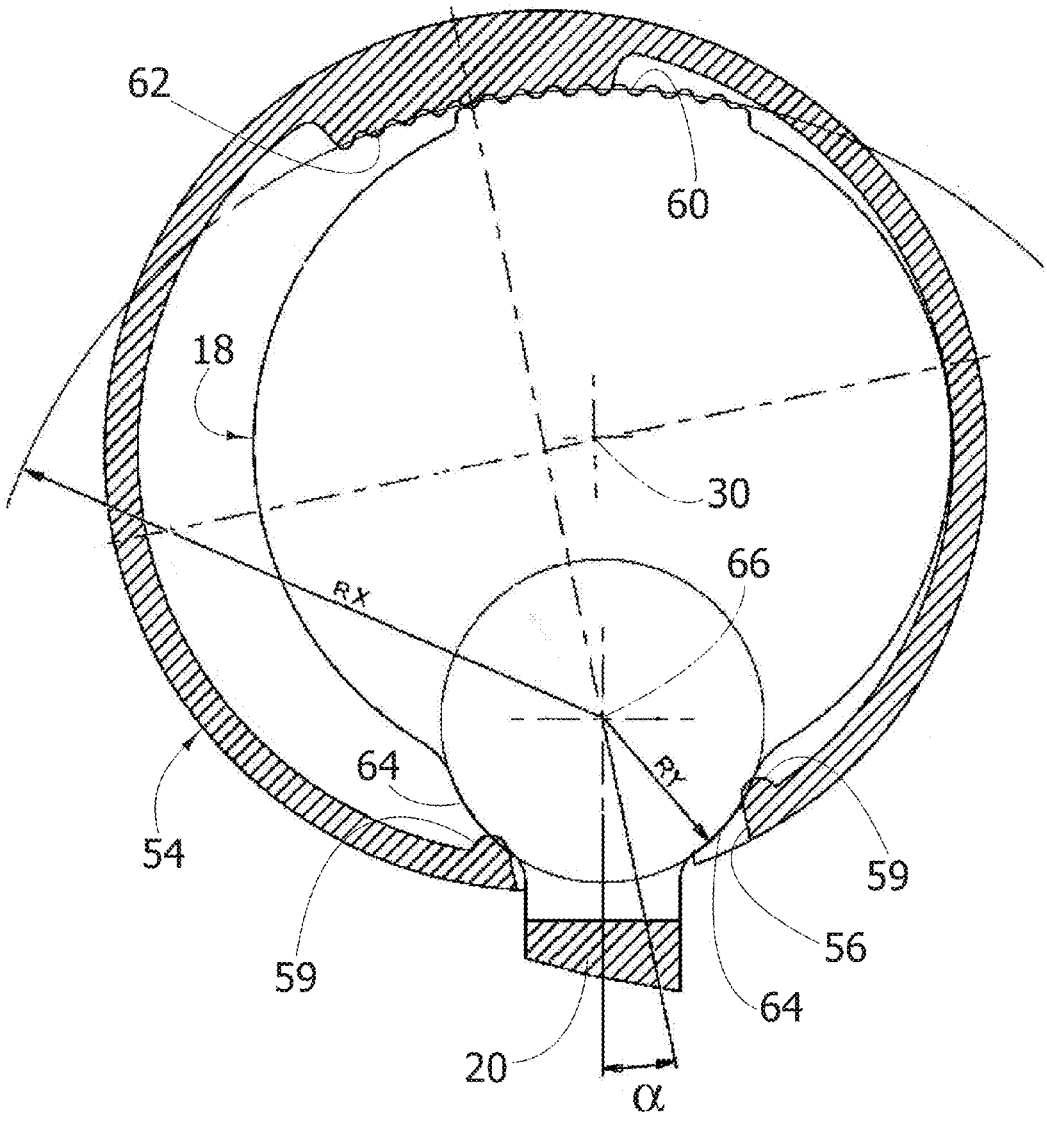

With reference to FIGS. 4 to 6, the articulation portion 18 is provided, on its outer surface, with a toothed area 60 set in a position diametrally opposite to the leaf 20. The toothing 60 is formed by undulated profiles that extend parallel to the longitudinal axis of the articulation portion 18. A toothing 62 of a complementary shape is formed on the inner surface of the covering sleeve 54, in a position diametrally opposite to the opening 56. The toothings 60, 62 mesh together and withhold the covering sleeve 54 in a selected position with respect to the articulation portion 18.

The leaf 20 of the hinge element 12 extends through the opening 56 of the covering sleeve 54. The leaf 20 is radiused to the outer cylindrical surface of the articulation portion 18 by means of two convex radiusing surfaces 64 defined by a circumference of radius RY having the centre on an axis 66 contained in a plane passing through the hinge axis 30. The toothings 60, 62 lie on a circumference of radius RX with the centre on the same axis 66 of the circumference RY. Formed along the edges of the opening 56 are teeth 59 that rest on the convex radiusing surfaces 64. The distance between each point of the radiusing surface 64 and the toothing 60 is slightly greater than the distance in undeformed conditions between each tooth 59 and the toothing 62 of the covering sleeve 54. Consequently, when the sleeve 54 is mounted on the articulation portion 18, the sleeve 54 is subject to a slight elastic deformation that keeps the toothings 60, 62 in mutual engagement. This elastic force ensures anchorage of the covering sleeve 54 on the articulation portion 18. No further fixing means are necessary.

As FIGS. 4 to 6 show, the covering sleeve 54 can be displaced about the articulation portion 18 in one direction or the other with respect to a central position illustrated in FIG. 4. FIGS. 5 and 6 illustrate the two extreme positions of the covering sleeve 54.

The movement of the sleeve 54 with respect to the articulation portion 18 is a rotation about the axis 66.

The angle $\alpha$ indicates the maximum amplitude of the movement of rotation of the covering sleeve 54. The angle $\alpha$ can, for example, be in the region of 12°, which corresponds to a transverse displacement of approximately 1.6 mm between the centre of the sleeve 54 and the hinge axis 30.

Following upon rotation of the sleeve 54, the longitudinal axis of symmetry of the covering sleeve 54 is displaced in a direction substantially transverse to the hinge axis 30. This movement enables alignment of the outer surface of the sleeve 54 to the outer surface of the second hinge element 14. In this way, the outer surfaces of the second articulation portion 22 and of the covering sleeve 54 are aligned together, and the misalignment between the articulation portions 18, 22 that arises following upon adjustment of the relative position in a transverse direction between the first and second hinge elements 12, 14 is masked.

Preferably, the bottom end of the covering sleeve 54 is closed by a cap 66 snap-fitted to the covering sleeve 54. The top end of the covering sleeve 54 is open and is aligned to the top edge of the radial flange 36 (see FIG. 3).

While the foregoing is directed to embodiments of the present invention, other and further embodiments of the invention may be devised without departing from the basic scope thereof, and the scope thereof is determined by the claims that follow.

The invention claimed is:

1. A hinge for doors or windows, comprising:

a first hinge element and a second hinge element, which include, respectively, a first cylindrical articulation portion and a second cylindrical articulation portion with respective seats, wherein the first articulation portion has an external diameter smaller than an external diameter of the second articulation portion;

a hinge pin, which extends within said seats and defines a hinge axis;

an adjustment device, which is associated to the second articulation portion and is actuated for displacing with respect to one another said hinge elements in a direction substantially transverse to said hinge axis; and a covering sleeve, which is provided externally to the first articulation portion and has an external diameter equal to the external diameter of said second articulation portion, wherein the covering sleeve is mounted so that it rotates with respect to the first articulation portion about an axis that is eccentric with respect to said hinge axis and is displaced with respect to the first articulation portion in a direction substantially transverse to the hinge axis, the covering sleeve and the first hinge element being provided with toothings kept elastically in a condition of mutual engagement.

2. The hinge according to claim 1, wherein said toothings extend along a circumference with a radius extending from the axis of rotation of said covering sleeve.

3. The hinge according to claim 2, wherein said covering sleeve is provided with a slit, extending through which is a leaf of said first hinge element, and wherein formed along edges of said slit are teeth that rest on radiusing surfaces between said leaf and an outer cylindrical surface of the first articulation portion.

4. The hinge according to claim 3, wherein said radiusing surfaces extend along a circumference with a second radius extending from the axis of rotation of said covering sleeve.

5. The hinge according to claim 1, wherein said adjustment device comprises:

a cam mounted so that it rotates in the seat of the second hinge element, the cam including an eccentric seat that receives a top end portion of the hinge pin.

* * * * *